US006647589B1

(12) United States Patent
Youngwith

(10) Patent No.: US 6,647,589 B1
(45) Date of Patent: Nov. 18, 2003

(54) FURNITURE LEG PAD

(76) Inventor: Peter Henry Youngwith, 9221 S. Prairie View Dr., Highlands Ranch, CO (US) 80126

( * ) Notice: Subject to any disclaimer, the term of this patent is extended or adjusted under 35 U.S.C. 154(b) by 0 days.

(21) Appl. No.: 10/002,460

(22) Filed: Nov. 14, 2001

(51) Int. Cl.[7] ..... B60B 33/00

(52) U.S. Cl. ..... 16/18 CG; 248/345.1

(58) Field of Search ..... 16/18 CG, 42 R, 16/42 T, 18 R; 248/188.9, 345.1; 49/460, 461, 462; 428/71, 99, 100, 74

(56) References Cited

U.S. PATENT DOCUMENTS

| | | | | | |
|---|---|---|---|---|---|
| 3,041,775 | A | * | 7/1962 | Brown, Jr. et al. | 248/345.1 |
| 3,144,236 | A | * | 8/1964 | Clanin | 150/154 |
| 3,685,231 | A | | 8/1972 | Blose | |
| 3,884,495 | A | * | 5/1975 | Petock | 280/87.041 |
| 3,895,981 | A | * | 7/1975 | Tesch | 156/71 |
| 3,941,159 | A | * | 3/1976 | Toll | 138/147 |
| 3,960,354 | A | | 6/1976 | Simikoski | |
| 4,130,279 | A | * | 12/1978 | Ross | 273/108.21 |
| 4,232,081 | A | | 11/1980 | Pullan | |
| 4,323,610 | A | * | 4/1982 | Leverich | 428/68 |
| 4,443,508 | A | | 4/1984 | Mehl | |
| 4,700,430 | A | * | 10/1987 | Raftery | 16/18 CG |
| 4,817,902 | A | | 4/1989 | Mason | |
| 4,857,371 | A | * | 8/1989 | McClintock | 428/36.5 |
| D309,777 | S | | 8/1990 | Woods | |
| 4,999,233 | A | | 3/1991 | Probst | |
| 5,173,990 | A | * | 12/1992 | Owen | 16/18 CG |
| 5,297,011 | A | | 3/1994 | Triunfol | |
| 5,328,156 | A | | 7/1994 | Hoke | |
| 5,330,814 | A | * | 7/1994 | Fewell | 428/42.2 |
| 5,508,078 | A | | 4/1996 | Stalnaker | |
| 5,511,445 | A | * | 4/1996 | Hildebrandt | 74/558.5 |
| 5,564,782 | A | * | 10/1996 | LaGrange et al. | 297/272.4 |
| 5,603,140 | A | | 2/1997 | Pryce | |
| 5,701,635 | A | * | 12/1997 | Hawkes | 16/421 |
| 5,815,998 | A | | 10/1998 | Wamsher | |
| 5,946,737 | A | | 9/1999 | Fleege | |
| 6,103,335 | A | | 8/2000 | Zoller | |
| D437,723 | S | * | 2/2001 | Lees | D6/610 |
| 6,260,237 | B1 | | 7/2001 | McCue | |

* cited by examiner

*Primary Examiner*—Chuck Y. Mah
(74) *Attorney, Agent, or Firm*—Henry L. Smith, Jr.

(57) ABSTRACT

The device is a shaped piece of impact absorbing material adapted to be wrapped around a furniture or equipment leg, and secured on the leg by the elasticity of the material, or by securing means like straps or adhesive, and optionally including a light absorbing skirt or coating, or animal face attractive to children. The device protects the furniture leg or human feet from impact damage.

9 Claims, 5 Drawing Sheets

FURNITURE LEG PAD

BACKGROUND

1. Field of Invention

The field of the invention is a device for preventing damage to the legs of furniture or equipment caused by the impact of cleaning equipment with the legs, and for preventing damage to the feet of human beings, especially toe stubs, when human feet accidentally bump against furniture or similar legs.

2. Description of Prior Art

Various devices have been used from time to time to protect furniture legs and the feet of human beings from damage. Representative of prior art are the following patents. U.S. Pat. No. 4,817,902, Apr. 4, 1989, to Donald R. Mason discloses a corner protector assembly for cushioning the corners of tables and the like to prevent collisions between young children and the corners of furniture. The device is shaped like a corner of a rectangular object and is attached to the object by an elastic hem and tie strings. U.S. Pat. No. 6,103,335, Aug. 15, 2000, to the Zoller, Hummel, and Schumacher discloses another device for padding the corners of equipment housings. The device is comprised of a number of complex, shaped parts designed to work together to cover a rectangular object. To the best knowledge of the Applicant, prior art does not disclose similar padding devices specifically adapted to the legs of furniture or equipment.

SUMMARY OF INVENTION

The invention is a device designed to be wrapped around the leg of a piece of furniture or a piece of equipment in order to protect the leg from damage from cleaning equipment such as vacuum cleaners or floor polishers or human footware, or to protect the feet of human beings from damage caused by impact of feet against the leg of the furniture or equipment. Hereinafter in this Application, mention will be made only of furniture legs; however, the discussion unless otherwise noted will also apply to the legs of various items of equipment. Likewise, discussion of human foot injury also includes injury to the toes.

OBJECTS AND ADVANTAGES

The objects of the present invention are:

1. To protect the feet of human beings from damage or injury when human feet accidentally contact or collide with furniture legs, such as stubbing a toe.

2. To protect the legs of fine furniture or other equipment from damage due to the impact, with shoes, or cleaning equipment such as vacuum cleaners or floor polishers.

3. As referenced above, to simultaneously protect furniture legs from damage and human feet from injury.

4. To provide a simple and inexpensive device for protecting furniture legs and human feet.

5. To provide a device which is easy to attach to, and remove from, furniture legs.

6. To provide a device which has very low visibility when in position on furniture legs, thus avoiding interference with the decor of the room.

7. To provide a device for protecting furniture legs which also contains some representation of an animal, cartoon character or imaginary face which is attractive to children, especially to protect children's feet from injury upon contact with the legs of furniture or beds in their bedrooms.

8. To provide a device with the above animal face or similar representation which may also be attractive to children because it glows in the dark, or because it contains artificial animal eyes which reflect light when illuminated.

9. To provide a furniture leg protector which can be firmly and reliably secured to furniture legs by simple straps or other inexpensive means.

10. To provide a device which is adaptable to fit a wide range of shapes of furniture legs, furniture feet, other equipment support members, casters, etc.

11. To provide a device which protects furniture legs from wear or abrasion due to movement of the protective pad or the furniture.

12. To provide a furniture leg and human foot protector with the appearance of a rabbit face or other face attractive to children, covered with fur-like material and with small reflective eyes.

13. To provide a device to protect fine and valuable furniture such as antiques and other furniture in homes or dealer showrooms, thus reducing "shopworn" commercial inventory, and loss of value to antique furniture.

14. To prevent one of the most common injuries to human feet, namely injury to toes due to impact of the foot against legs and floor braces of beds, which are often hidden by bedspreads, and in particular, injury to toes due to impact against bed leg casters which often include sharp edges of the coaster device.

15. To provide a device which will stay in secure position around a furniture or equipment leg without straps because of the stiffness and elasticity of the molded impact absorbing material.

16. To provide a very simple device comprising a roll of impact absorbing material with adhesive backing, which may be easily and securely applied to a furniture leg by spirally wrapping the tape around the leg, so that the adhesive backing of the tape adheres to the furniture leg.

17. To provide a padding device with re-stick adhesive for reuse on another leg, or for repositioning on a leg when the original position was not suitable.

18. To provide a device, for protecting legs of delicate equipment, with a bright color or stripes to attract human attention to avoid impacts against the legs.

19. To provide a leg protecting device which is capable of being positioned so that its layers overlap to provide more impact protection.

Still further objects and advantages will become evident from the detailed description of the invention, and the drawings.

DRAWING FIGURES

Figure 1:
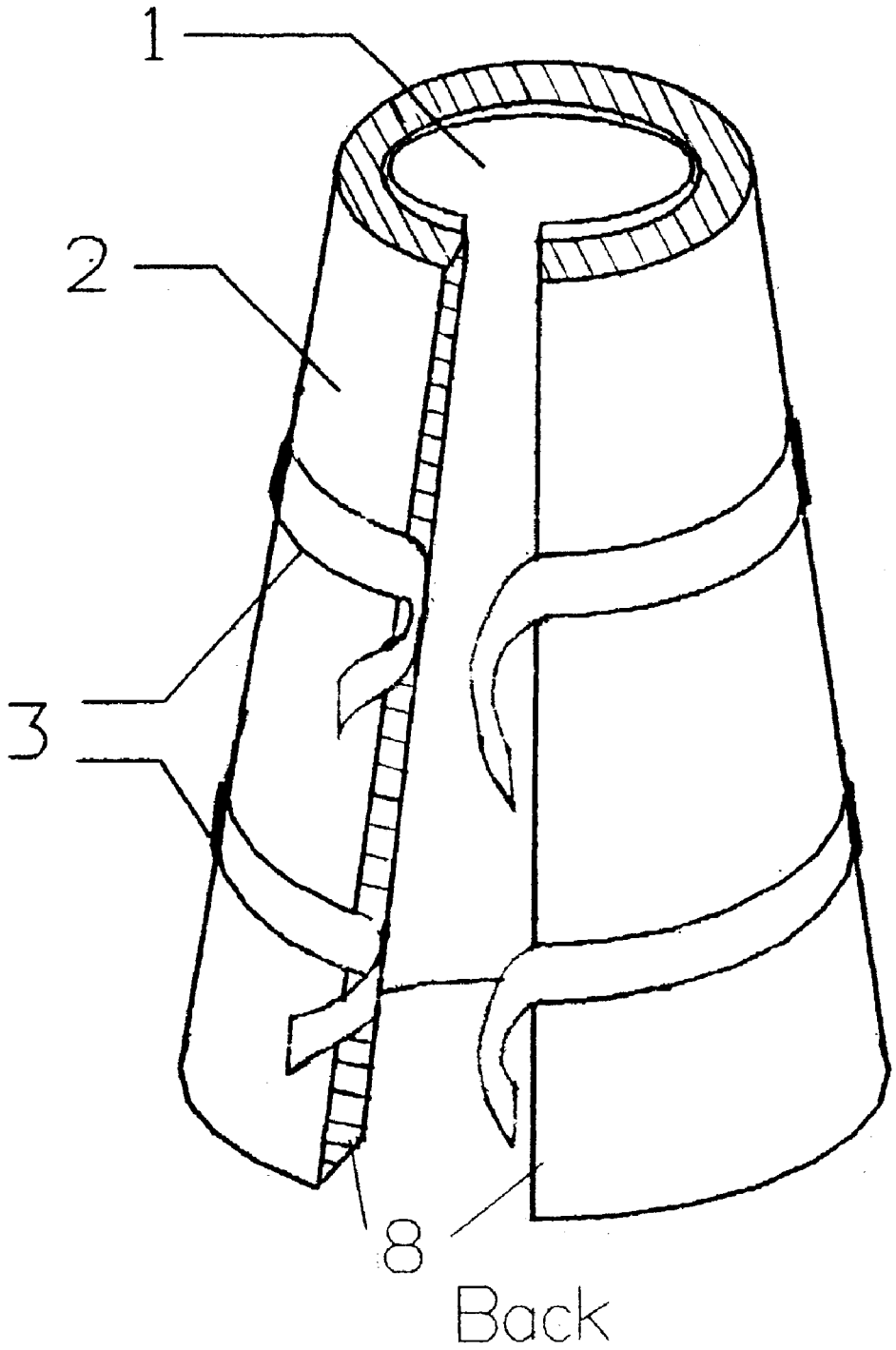
FIG. 1 shows the basic structure of the device comprising a layer of shaped impact absorbing material and securing straps; this version of the invention does not show any decorative or light absorbing covering of the invention.

REFERENCE NUMERALS IN DRAWINGS 1. inner lining or coating
2. impact absorbing material
3. securing means
4. light-absorbing skirt
5. animal face
6. animal eyes
7. animal fur-like skirt
8. impact absorbing material edges
9. securing-means slots
10. upper skirt retaining means
11. outer light-absorbing coating
12. adhesive coating
13. furniture leg

DETAILED DESCRIPTION OF THE DRAWINGS

Figure 2:
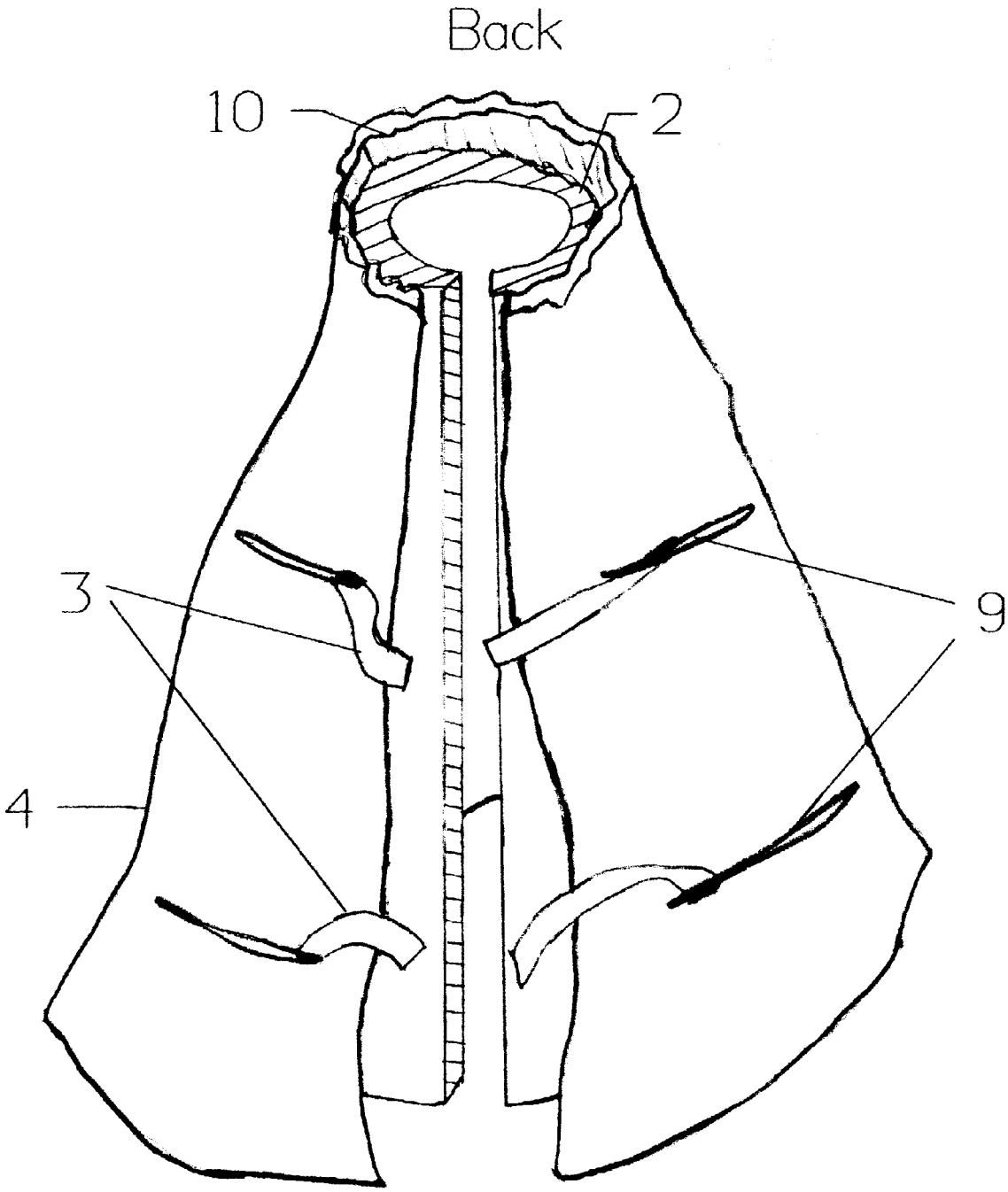
FIG. 2 is a back view of the invention with an external generally flat black light-absorbing skirt.
Figure 3:
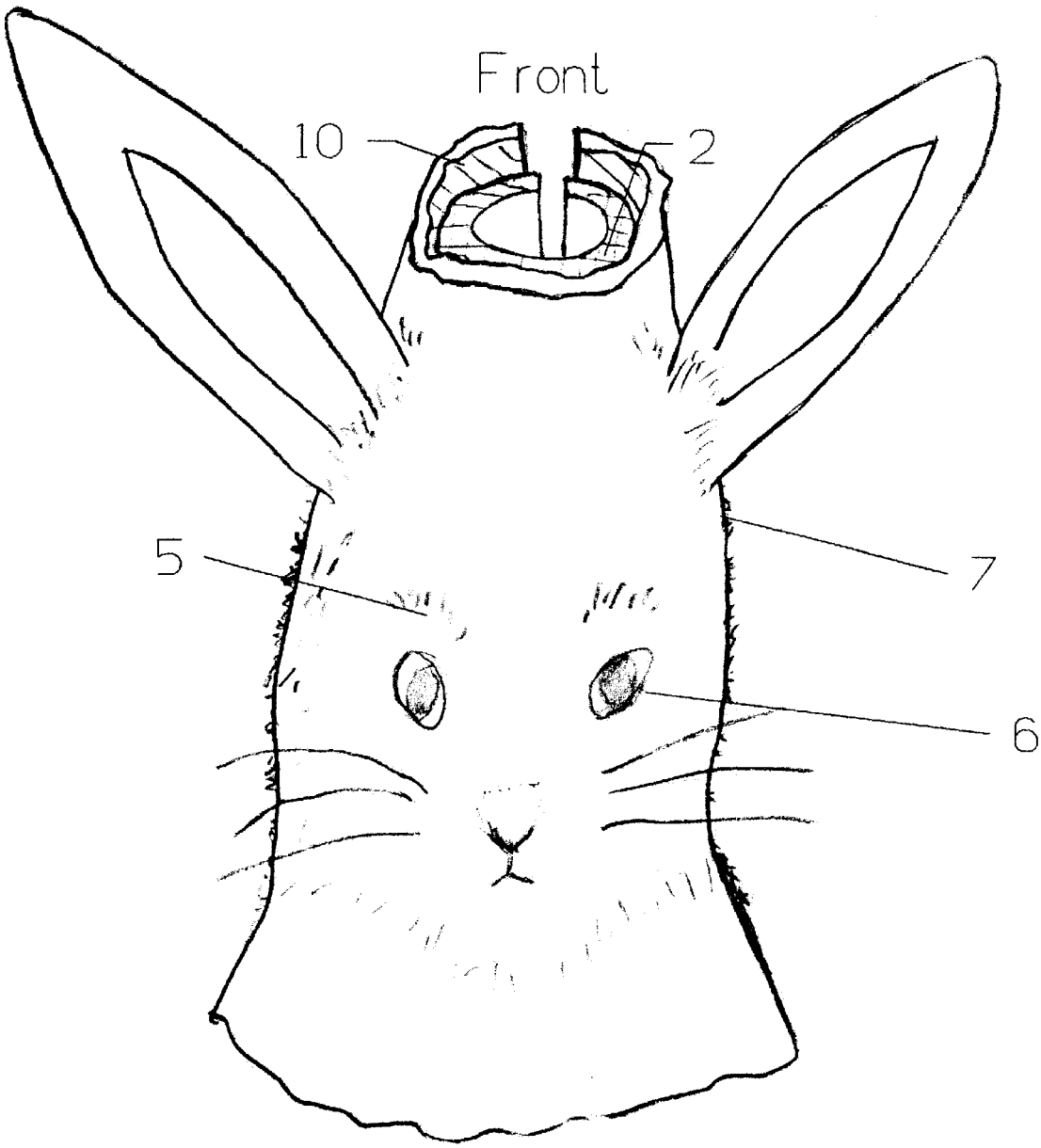
FIG. 3 shows a version of the invention with a representation of an animal, cartoon, or imaginary face attached to a fur-like skirt.
Figure 4:
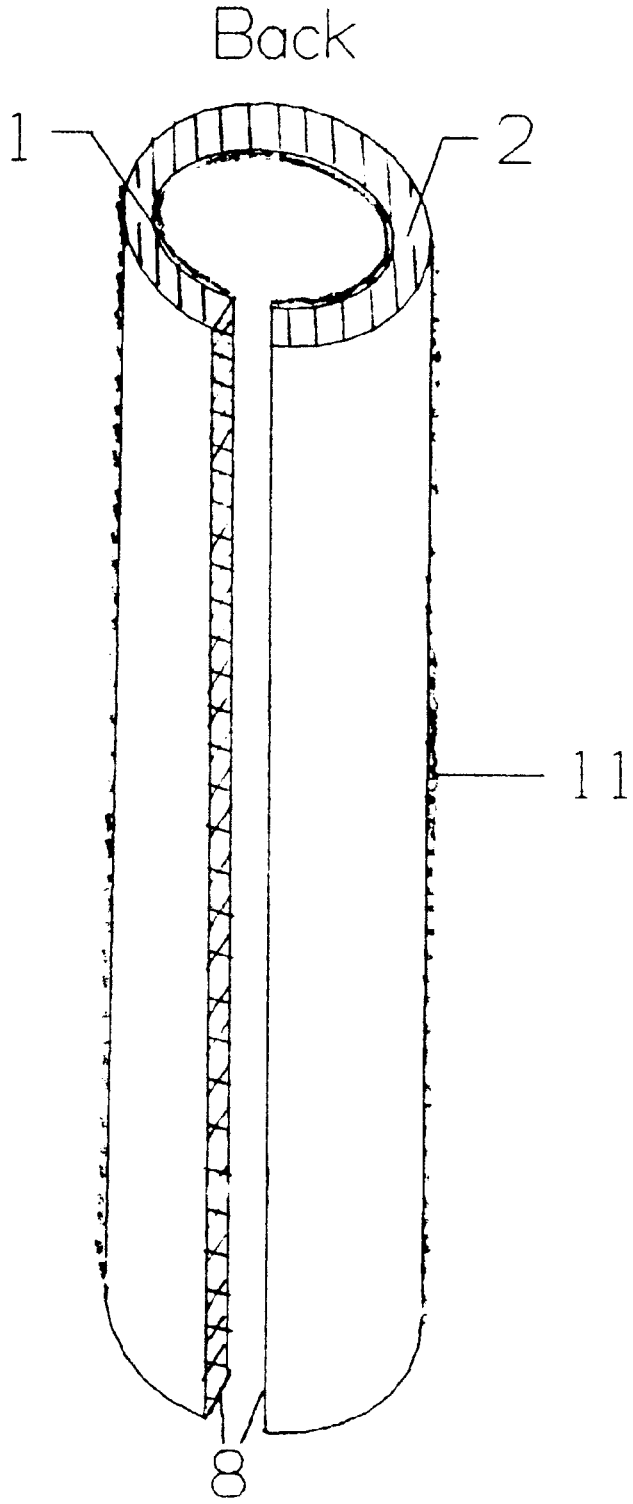
FIG. 4 shows a version of the invention for cylindrical furniture legs, with enough elasticity so that the impact absorbing material closes around the furniture legs and stays in position without straps, etc.
Figure 5:
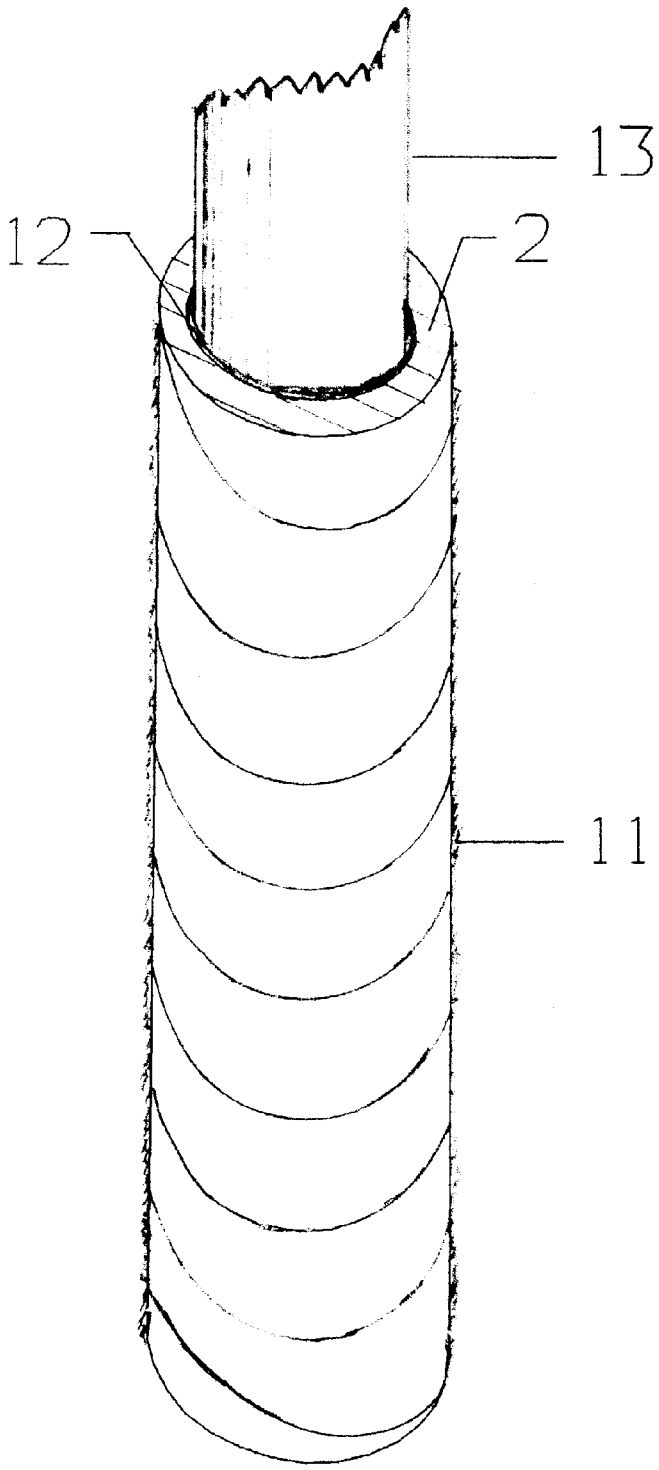
FIG. 5 shows the version of the invention comprising a strip of impact absorbing material with adhesive backing applied to a furniture leg.

FIG. 1 shows a typical embodiment of the invention comprising a pad of shaped energy or impact absorbing material 2, and inner lining or coating 1 inside the impact absorbing material, and securing means 3 for securing the impact absorbing material edges 8 against each other when the device is wrapped around a furniture leg, or for securing impact absorbing material edges 8 in an overlapped position in the case where the furniture leg is small, or where the furniture leg has a shape other than cylindrical, or where the furniture leg may have a large foot or caster on the bottom, yet has a substantially smaller diameter at the top. FIG. 2 shows an optional part of the invention, the light-absorbing skirt 4, designed to absorb substantially all of the light falling upon it. The securing means slots 9 allow the securing means, for example straps, to pass through the light-absorbing skirt 4. An upper skirt retaining means 10 can be used to more securely hold light absorbing skirt 4 in place over the device when in position on a furniture leg. FIG. 3 shows a version of the invention designed to be attractive to children comprising in addition an outline of an animal face 5, animal eyes 6, and animal fur 7. FIG. 4 shows a version of the invention where the impact absorbing material 2 has enough elasticity to close around a cylindrical furniture leg around which it is applied so that the impact absorbing material edges touch each other along substantially their entire length. An outer light-absorbing coating 11 is on the outside of material 2. FIG. 5 shows a tape-like version of the device with a long strip of impact absorbing material 2 and adhesive coating 12 and outer light-absorbing coating 11 applied to a cylindrical furniture leg 13.

DESCRIPTION—PREFERRED EMBODIMENT

The preferred embodiment of the invention involves a rectangular piece of impact absorbing material 2 as shown in FIG. 4 which has been shaped (for example by heat) in a generally cylindrical shape with an opening in the cylinder created by impact absorbing material edges 8. A very similar preferred embodiment would be comprised of a trapezoidal piece of impact absorbing material 2 shaped generally in the shape of a truncated cone, as shown in FIG. 1. This version of the invention is better adapted for furniture legs containing feet or casters at the bottom. In other words, the trapezoidal shape of impact absorbing material 2 provides more material along the extended base of the trapezoid so that the device can be wrapped around a furniture leg containing a foot or caster at the end, while at the same time enabling the impact absorbing material edges 8 to touch each other, so that the impact absorbing material 2 can cover the entire surface of the lower portion of the furniture leg containing the foot or caster, etc. From the aesthetic point of view, the preferred embodiment of the invention would be the version with the extra light absorbing skirt 4 which makes the device of low visibility when in position on the furniture leg, or the version with the animal face 5 which is attractive to children. Typical dimensions for the device might be approximately 6 inches in length of the cylinder and 3 inches in diameter. The impact absorbing material 2 might be in the neighborhood of ¾ inch thick, although all these dimensions may vary widely depending on the size of the furniture leg to be protected and the impact absorbing ability of the material. The inner lining or coating 1 could be comprised of a material like vinyl plastic or similar material in the range of five mils thick, or a plastic or rubber-like material applied by brushing or spraying. The impact absorbing material 2 could be comprised of one or more of a variety of plastic foams, artificial or natural rubber, foams of artificial or natural rubber, or even a thick matted fibrous material, or bubble wrap. Bubble wrap is a material made of a flat plastic layer, on top of which is attached a similar layer containing a multitude of closely spaced air bubbles. A typical plastic impact absorbing material would be ethylpropylene ethylene (EPE) in the range of ½ inch thick.

OPERATION OF THE INVENTION

One of the great advantages of the invention is the simplicity of its operation. To use the device, the user applies gentle finger pressure to open the cylindrical, or truncated cone, device at the impact absorbing material edges 8. The open device is then wrapped around the furniture leg, and the two impact absorbing material edges 8 are secured in contact with each other, or are secured in overlapping position for smaller legs, by securing means 3. The securing means 3 could include a Velcro (TM) pair of hook and loop parts, rectangular straps which could be tied to each other, a fabric strap with a buttonhole and a button, a fabric strap with a hook and eyelet, a strap with snap button and mating button or other similar attachment means known to those skilled in the art. In each case a strap is on one side of the impact absorbing material edges 8, and the other strap (or button, hook, or mating button, etc.) is on the opposite side of impact absorbing material edges 8, as shown in FIG. 2. The embodiment of the invention designed to be inconspicuous when in position on the furniture leg achieves its goal by means of a flat black, light-absorbing skirt 4 on the outside of the device. The skirt 4 has securing means slots 9 through which the straps, Velcro members, snap button members, etc. can pass, and be secured to the impact absorbing material 2 beneath skirt 4. An embodiment of the invention designed to be attractive to children achieves this goal by having on the outside of the device an animal-like face 5 complete with reflective eyes 6 and fur 7. All or portions of the face could be made of glow in the dark material. The face could be attached directly to the outside of the impact absorbing material 2, or to the outside surface of skirt 4.

TESTS

The Applicant has performed tests to demonstrate that the device in either its cylindrical or truncated cone version can easily be adapted to furniture legs of different diameters, and containing casters or feet at the end. The Applicant has also performed tests with a version of the invention containing light-absorbing skirt 4 which demonstrates that the device is of low visibility when in position on furniture legs near the floor, unless there is an unusual amount of light. The Applicant has demonstrated that the device absorbs the impact of human feet or toes against the furniture leg without harm to the foot or toes. The Applicant has also performed tests to demonstrate that the version of the device with an animal face is also interesting and attractive to children.

ADDITIONAL EMBODIMENTS

Many embodiments of the device are possible including different sizes of the device adapted to legs of many different lengths and diameters. The impact absorbing material 2 may be molded in a cylindrical or truncated cone shape, but may also be in the form of a flat piece which requires the user to bend it into position around the furniture leg. The device may also be made from material in shapes in addition to a rectangle or trapezoid. For example, the impact absorbing material edges 8 might engage each other in the form of alternate projections and indentations along the edges 8, in a fashion like meshing teeth. A number of rubber or plastic foams, plastic encapsulated gels, matted fibrous material, or "bubble wrap" known to those skilled in the art are usable for the impact absorbing material 2, and the impact absorbing material may come in a wide range of thicknesses and impact absorbing abilities. The impact absorbing material 2 may be stiff and elastic enough after molding to conform to the shape of the furniture leg without securing means 3. The inner lining or coating 1 may be made in varying thicknesses of various smooth materials designed to minimize abrasion against the surface of furniture legs. The securing means 3, whether in the form of simple straps or engaging Velcro materials, may be attached to the impact absorbing material 2 in a number of ways including gluing, stitching, or heat bonding. Many animal faces 5 are possible for the device, and such faces may be covered with animal fur, either artificial or natural, of many kinds, and may include reflective or non-reflective animal eyes 6 of varying designs and colors. Other faces attractive to children may be used including imaginary or cartoon characters. Glow in the dark parts of the animal face may be used. Such parts may contain calcium sulfide which absorbs light when exposed to light and then emits light in the dark. Even without the optional light-absorbing skirt 4, the device may be made very low visibility by using low-reflectance flat black parts or spray painting the device with flat black paint after assembly. An upper skirt retaining means 10 may be used as positioned in FIG. 3 to secure the skirt 4 to the upper portion of the furniture leg to prevent it from slumping down toward the floor. The skirt could use a band made of spring metal positioned inside the upper portion of the skirt 4, as shown in FIG. 3, or it could be attached by another securing means 3 attached to the outside of the skirt 4. The upper skirt retaining means 10 could be a plastic coated twist-tie wire, or tie straps or other similar devices known to those skilled in the art. Another version of the invention, shown in FIG. 5, comprises a long, generally rectangular strip of impact absorbing material 2 with an adhesive coating 12 on one of the long rectangular surfaces, and a flat black, light-absorbing coating 11 on the opposite rectangular surface. The strip can be wrapped around the furniture leg 13 to be protected in a generally spiral fashion, so that the strip covers the portion of the leg to be protected. The adhesive 12 holds the strip to the furniture leg, in a generally permanent attachment, although some adhesives may permit the strip to be removed from the leg. Suitable adhesives would probably include an adhesive composition comprising as a main component of one or more than one kind of copolymer selected from (1) ethylene-vinyl acetate copolymer; (2) copolymer of ethylene, vinyl acetate, and acrylate and/or methacrylate monomer; (3) copolymer of ethylene, vinyl acetate, and maleic acid and/or maleic anhydride; and (4) copolymer of ethylene, acrylate and/or methacrylate monomer, and maleic acid and/or maleic anhydride. One suitable adhesive is Duro (R) All-Purpose Spray Adhesive available from K -MART, Troy, Mich., which may be used and which can adhere to the legs more than once, to permit reuse of the device on other legs, or to permit repositioning on the legs if the first position of the device is not suitable. Alternatively, the outside surface of the strip could have a bright color, a reflective surface, or a striped pattern to call attention to the legs of delicate equipment to avoid impact by human feet or other equipment. The adhesive could be protected prior to use by a tear off strip of paper or plastic which temporarily adheres to the adhesive. If increased impact cushioning is desired, the impact absorbing material 2 can be applied as more than one layer. The various versions of the device could be made large enough so. that impact absorbing material layers overlap when in position on the legs to provide more impact absorption.

CONCLUSIONS, RAMIFICATIONS AND SCOPE

A number of changes are possible to the device shape, materials, sizes, and securing means described above, while still remaining within the scope and spirit of the invention.

The specifics about the form of the invention described in this application are not intended to be limiting in scope. The scope of the invention is to be determined by the claims, and their legal equivalents, not the examples given above.

I claim:

1. A device for protecting furniture or equipment legs and human feet comprising:

a. one or more shaped pieces of impact absorbing material, adapted to receive a leg through an opening therein and adapted to be wrapped around the leg, b. one or more securing means adapted to hold the impact absorbing material in place when wrapped around the leg, and c. a light absorbing skirt releasably attached around the outside surface of the device.

2. The device of claim 1 wherein the skirt has securing means slots through which the securing means can be passed or accessed, whereby the securing means can secure the impact absorbing material around the leg.

3. A device for protecting furniture or equipment legs and human feet comprising:

a. one or more shaped pieces of impact absorbing material, adapted to receive a leg through an opening therein and adapted to be wrapped around the leg, b. one or more securing means adapted to hold the impact absorbing material in place when wrapped around the leg, and c. an animal fur-like skirt releasably attached around the outside surface of the device.

4. The device of claim 3 further comprising an animal face or other face representation attached to the outside surface of the skirt.

5. The device of claim 4 further comprising light-reflecting animal eyes representations attached to the face.

6. The device of claim 4 wherein all or part of the animal or other face representation is made of glow in the dark material.

7. A device for protecting furniture or equipment legs and human feet comprising:

a. one or more shaped pieces of impact absorbing material, adapted to receive a leg through an opening therein and adapted to be wrapped around the leg, b. one or more securing means adapted to hold the impact absorbing material in place when wrapped around the leg, and c. a skirt member capable of being attached around the device when the device is in position on the leg, and wherein the skirt member contains an upper skirt retaining means attached to the upper portion of the skirt member and capable of being secured around the skirt member and leg.

8. The device of claim 7, wherein the upper skirt retaining means is attached to the skirt member and is selected from the group consisting of:

a. one or more part circle or part oval bands of spring-like material, b. one or more pairs of straps adapted to be tied together by a knot, c. one or more straps with Velcro (TM) hooks and corresponding hook engaging material, d. one or more straps with buttonhole and corresponding button, e. one or more straps with hook and corresponding eyelet, f. one or more straps with snap button and corresponding mating snap button, and g. one or more plastic coated wires securable by twisting its ends.

9. A device for protecting furniture or equipment legs and human feet comprising:

a. one or more shaped pieces of impact absorbing material, adapted to receive a leg through an opening therein and adapted to be wrapped around the leg.

b. one or more securing means adapted to hold the impact absorbing material in place when wrapped around the leg, wherein the device has been coated with a light absorbing material, whereby the device exhibits low visibility when in position on the leg.

* * * * *